US009724752B2

(12) United States Patent
Shergold

(10) Patent No.: US 9,724,752 B2
(45) Date of Patent: Aug. 8, 2017

(54) APPARATUS AND METHOD FOR EMBEDDING AN ELEMENT

(75) Inventor: Mike Shergold, Coventry (GB)

(73) Assignee: Jaguar Land Rover Limited, Whitley, Coventry (GB)

( * ) Notice: Subject to any disclaimer, the term of this patent is extended or adjusted under 35 U.S.C. 154(b) by 0 days.

(21) Appl. No.: 14/127,776

(22) PCT Filed: Jun. 21, 2012

(86) PCT No.: PCT/EP2012/062041

§ 371 (c)(1),
(2), (4) Date: Mar. 10, 2014

(87) PCT Pub. No.: WO2012/175648

PCT Pub. Date: Dec. 27, 2012

(65) Prior Publication Data

US 2014/0190651 A1 Jul. 10, 2014

(30) Foreign Application Priority Data

Jun. 21, 2011 (GB) ..... 1110489.0

(51) Int. Cl.
*B22C 9/00* (2006.01)
*B22C 21/14* (2006.01)
(Continued)

(52) U.S. Cl.
CPC ..... *B22C 9/00* (2013.01); *B22C 21/14* (2013.01); *B22D 19/00* (2013.01); *B22D 19/02* (2013.01)

(58) Field of Classification Search
CPC ..... B22C 9/00; B22C 21/14; B22D 19/00; B22D 19/02
(Continued)

(56) References Cited

U.S. PATENT DOCUMENTS 4,492,265 A * 1/1985 Donomoto ..... C22C 47/025 164/103
4,894,972 A 1/1990 Endoh et al.
(Continued)

FOREIGN PATENT DOCUMENTS

DE 4102358 A1 7/1992
DE 10 2006 034 341 A1 1/2008
(Continued)

OTHER PUBLICATIONS

Combined Search and Examination Report, GB1110489.0, Dec. 23, 2011, 5 pages.

*Primary Examiner* — Kevin P Kerns
*Assistant Examiner* — Steven Ha
(74) *Attorney, Agent, or Firm* — Myers Bigel, P.A.

(57) ABSTRACT

Embodiments of the present invention provide apparatus for forming a component from a solidified fluid medium. The apparatus comprises a body defining a cavity into which the fluid medium may be introduced, the cavity optionally being shaped to define a shape of the component, and a carrier for supporting one or more elements to be embedded in the component. The carrier is arranged to be introduced into the cavity to support the one or more elements within the cavity while the fluid medium is introduced into the cavity. Embodiments of the invention are useful in a range of fabrication technologies including casting of metals and injection molding operations.

12 Claims, 5 Drawing Sheets

(51) Int. Cl.
*B22D 19/00* (2006.01)
*B22D 19/02* (2006.01)

(58) Field of Classification Search
USPC ..... 164/397, 398, 112, 332–334
See application file for complete search history.

(56) References Cited

U.S. PATENT DOCUMENTS

| | | | | |
|---|---|---|---|---|
| 5,297,609 | A | 3/1994 | Cook | |
| 5,524,699 | A * | 6/1996 | Cook | 164/97 |
| 5,715,887 | A | 2/1998 | Hosokawa | |
| 8,176,967 | B2 | 5/2012 | Henkel et al. | |
| 2004/0035547 | A1 * | 2/2004 | Grether | B22D 19/14 164/98 |
| 2004/0099398 | A1 * | 5/2004 | Meyer | 164/137 |
| 2007/0271793 | A1 * | 11/2007 | Mellis | B22D 17/007 29/897.2 |
| 2008/0060778 | A1 * | 3/2008 | Velasco-Tellez et al. | 164/20 |
| 2008/0245229 | A1 * | 10/2008 | Buschbeck | B22D 19/0027 92/186 |
| 2009/0020256 | A1 * | 1/2009 | Hanna | B22D 19/04 164/75 |
| 2009/0233116 | A1 * | 9/2009 | Henkel et al. | 428/544 |

FOREIGN PATENT DOCUMENTS

| | | | |
|---|---|---|---|
| JP | 2005-186151 | A | 7/2005 |
| WO | WO 02/07914 | A1 | 1/2002 |

* cited by examiner

APPARATUS AND METHOD FOR EMBEDDING AN ELEMENT

RELATED APPLICATIONS

This application is a 35 U.S.C. §371 national stage application of PCT Application No. PCT/EP2012/062041, filed on Jun. 21, 2012, which claims priority from Great Britain Patent Application No. 1110489.0, filed Jun. 21, 2011, the contents of which are incorporated herein by reference in their entireties. The above-referenced PCT International Application was published in the English language as International Publication No. WO 2012/175648 A1 on Dec. 27, 2012.

FIELD OF THE INVENTION

The present invention relates to the fabrication of a component. In particular but not exclusively the invention relates to fabrication of a component by casting and to a component having an element embedded therein. Aspects of the invention relate to an apparatus, to a method and to a component, structure or vehicle.

BACKGROUND

It is known to fabricate a component from aluminium (or aluminum) metal by casting. Aluminium components are often preferred over heavier metals in applications such as aerospace and automotive where optimising a strength to weight ratio of the component is desirable.

In order to increase a strength of a component it is known to embed a reinforcement element in the component. Components fabricated from metal matrix composite (MMC) materials such as an aluminium matrix composite (AMC) may be used to form reinforcement elements for embedding in castings.

In some arrangements, reinforcement elements are embedded in an aluminium component by attaching the elements to or otherwise supporting the elements against an interior wall of a mould into which molten aluminium is subsequently poured.

This method of fabrication has the disadvantage that an operator may forget to place a reinforcement element into the mould before casting the molten aluminium into the mould. For example, if the casting requires a number or different reinforcement elements arranged in a complex fashion within the mould cavity, placement of the reinforcement elements may be a non-trivial task. Furthermore, it may be difficult or impossible to determine from an outward appearance of a cast component whether or not a reinforcement element is present within the component.

In arrangements where a reinforcement element is located to the mould tool directly, there may be a witness of the AMC reinforcement evident outside of the casting. Such a witness may be unsightly or affect the functional or corrosion performance of the casting. Removal by subsequent machining may be expensive.

It is an aim of embodiments of the present invention to at least partially mitigate the disadvantages of known methods of fabricating cast components.

STATEMENT OF THE INVENTION

According to one aspect of the invention there is provided apparatus for forming a component from a solidified fluid medium, the apparatus comprising: a body defining a cavity into which the fluid medium may be introduced; and a carrier for supporting one or more elements to be embedded in the component, the carrier being arranged to be introduced into the cavity to support the one or more elements within the cavity whilst the fluid medium is introduced into the cavity.

This feature has the advantage that the carrier may be prepared outside the cavity (for example as a pre-assembled component) and then introduced into the cavity in a relatively straightforward operation.

An operator may be able to verify that the one or more elements are present in the cavity by checking that the carrier has been introduced into the cavity. Furthermore, by inspecting the carrier prior to introducing it into the cavity the operator may verify that the one or more elements are present. It is to be understood that the cavity may be a cavity defined by a mould tool into which fluid medium such as molten metal or a plastics material is to be introduced.

Optionally, the cavity may be shaped to correspond substantially to a shape of the component. The cavity may be shaped substantially to the shape of the component.

Advantageously the carrier may be arranged to be supported by the body.

Further advantageously the carrier may be arranged to be coupled to the body defining the cavity thereby to prevent relative movement between the carrier and the body.

Optionally one or more portions of the carrier are arranged to abut one or more corresponding portions of the body thereby to allow the carrier to be supported in a prescribed position and orientation within the cavity.

Advantageously the body may be provided with one or more recesses within the cavity into which a corresponding one or more portions of the carrier may be introduced.

Optionally the body is provided with one or more protrusions within the cavity, the carrier having a corresponding one or more portions into which the one or more protrusions of the body may be introduced.

Advantageously the carrier may comprise coupling means for coupling the one or more elements thereto.

Optionally the coupling means comprises one or more tabs arranged to be folded around a portion of an element to couple the element to the carrier.

Other coupling means are also useful, such as by fixing elements. In some arrangements an adhesive may be employed. Welding or other joining method may be employed in some embodiments.

Advantageously the carrier may comprise a carrier body having at least one arm portion protruding therefrom, the arm portion being arranged to be coupled to a portion of the body thereby to support the carrier body in the cavity.

Optionally the carrier body has a plurality of arm portions protruding therefrom for supporting the carrier body in the cavity.

Further optionally the carrier comprises a sheet of material.

Optionally the carrier is formed from a material comprising substantially the same material as the fluid medium to be introduced.

This feature has the advantage that in some arrangements a local change in composition of a component formed when the fluid medium solidifies due to the presence of the carrier may be avoided.

For example the fluid medium may be an aluminium alloy and the carrier may be formed from an alloy of substantially the same composition.

Alternatively the material may be formed substantially from one or more elements of which a major proportion of the fluid medium to be introduced is comprised. For example the fluid medium may be an aluminium alloy and the carrier may be formed substantially from aluminium. Other arrangements are also useful.

Further optionally the carrier is formed to have a melting temperature higher than that of the fluid medium to be introduced.

The carrier may be formed to have a melting temperature sufficiently high that the carrier does not deform or otherwise allow the one or more elements to move when the fluid medium is introduced into the cavity.

Optionally the carrier is formed from aluminium.

Advantageously the at least one element comprises a reinforcement element for reinforcing the component.

Further advantageously the at least one element comprises a metal matrix composite material.

The at least one element may comprise an aluminium matrix composite (AMC) material.

The at least one element may comprise a porous alumina structure within and/or around which a metal matrix is provided. The metal matrix may be aluminium, an aluminium alloy, a different alloy or any other suitable material.

According to a further aspect of the invention there is provided a carrier for supporting one or more elements to be embedded in a component formed from a solidified fluid medium, the carrier being arranged to be introduced into the cavity to support the one or more elements within the cavity whilst the fluid medium is introduced into the cavity, the carrier being coupled to at least one said one or more elements.

According to a still further aspect of the invention there is provided a method of fabricating a component comprising: providing a body defining a cavity into which a fluid medium may be introduced, introducing a carrier into the cavity, the carrier supporting one or more elements to be embedded in the component; and introducing the fluid medium into the cavity whereby the one or more elements are at least partially embedded in the fluid medium.

The method may comprise the step of providing a body defining a cavity, the cavity being shaped to define a shape of the component.

Optionally the step of introducing a fluid medium comprises the step of introducing a molten material.

Optionally the molten material comprises a molten metal.

Further optionally the carrier is formed from a material having a melting temperature higher than that of the fluid medium.

Advantageously the step of introducing the fluid medium comprises introducing the fluid medium whereby the carrier becomes at least partially embedded in the fluid medium.

Optionally the method comprises casting the component.

Alternatively the method may comprise injection moulding the component.

According to another aspect of the invention there is provided a pre-assembled carrier supporting one or more elements to be embedded in a component, the carrier being arranged to be introduced into the cavity to support the one or more elements within the cavity whilst the fluid medium is introduced into the cavity thereby to enable said one or more elements to be provided at a predetermined one or more locations within the component.

According to yet another aspect of the invention there is provided a component, structure or vehicle manufactured or fabricated using a method or apparatus of any preceding aspect.

Within the scope of this application it is envisaged that the various aspects, embodiments, examples, features and alternatives set out in the preceding paragraphs, in the claims and/or in the following description and drawings may be taken independently or in any combination thereof. For example, features disclosed in connection with one embodiment are applicable to all embodiments, except where there is incompatibility of features.

BRIEF DESCRIPTION OF THE DRAWINGS

Embodiments of the invention will now be described, by way of example only, with reference to the accompanying drawings, in which.

DETAILED DESCRIPTION

Figure 1A:
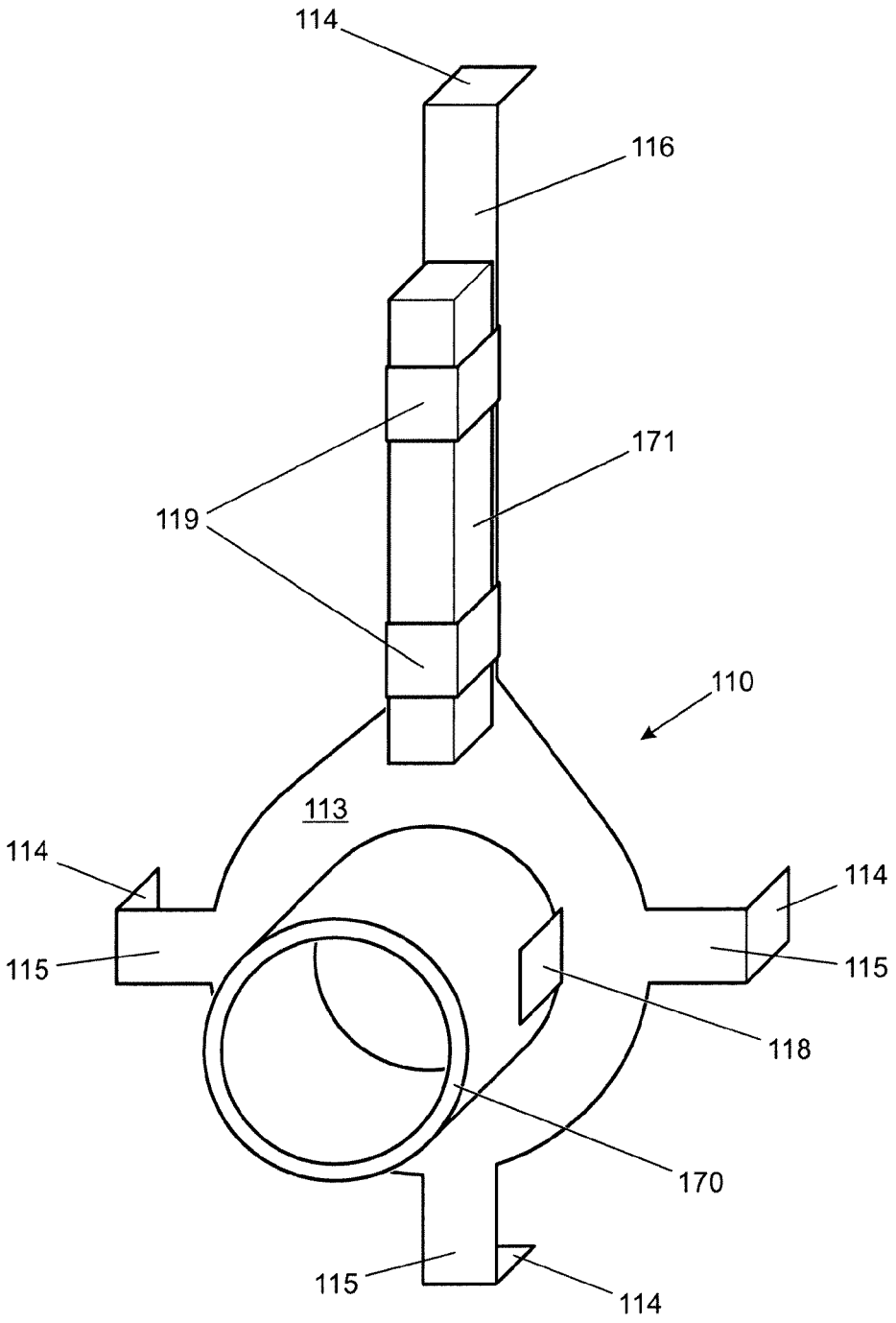
FIG. 1 is a schematic illustration of (a) a carrier according to an embodiment of the present invention and (b) a net of the carrier.
Figure 1B:
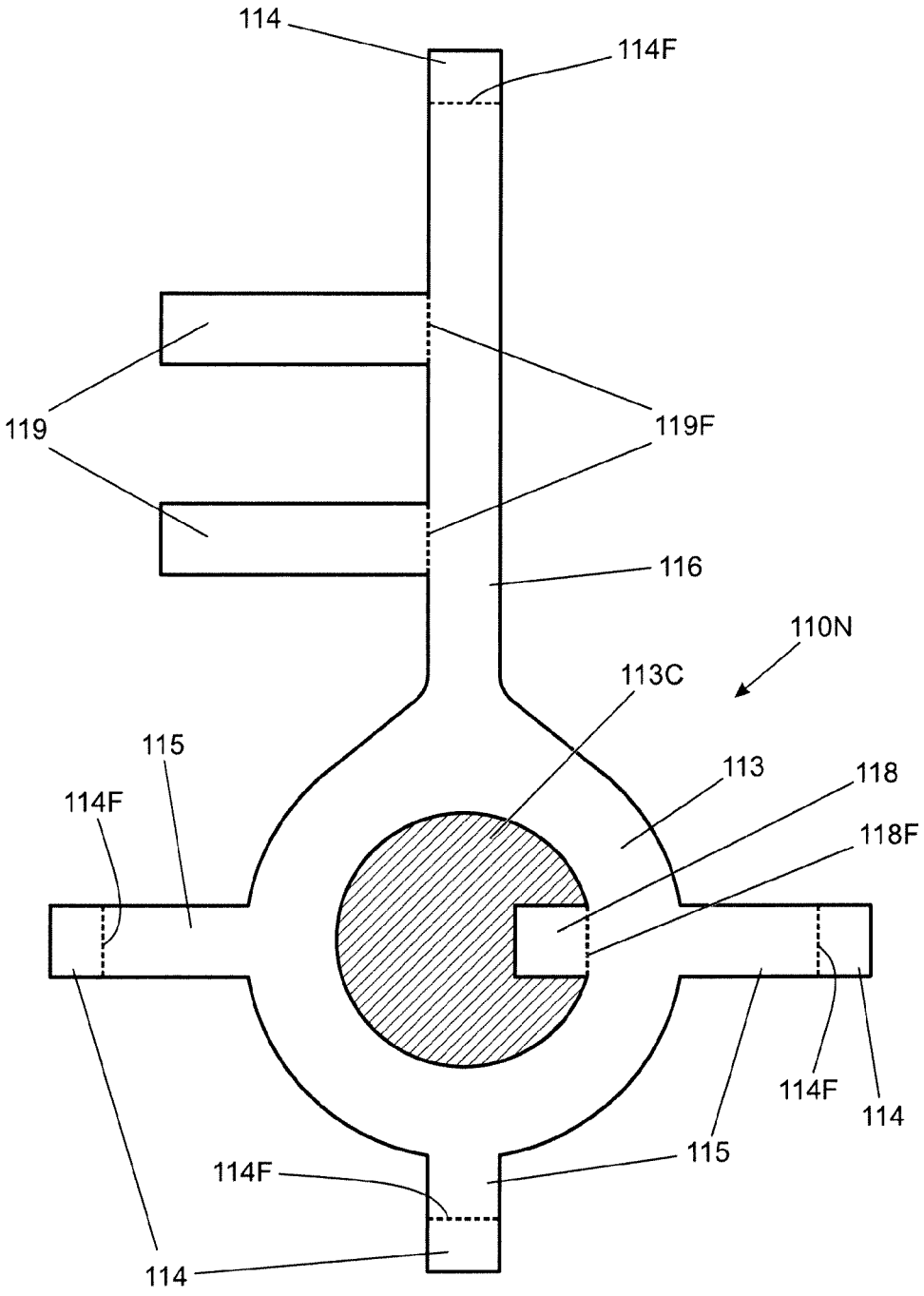

FIG. 1 shows a carrier 110 according to an embodiment of the present invention suitable for use in a fabrication method according to an embodiment of the present invention. The carrier 110 is designed to support two reinforcement elements 170, 171 that are to be embedded in a metal casting. A first reinforcement element 170 is in the form of a hollow tubular reinforcement element 170 whilst the second reinforcement element 171 is in the form of a cuboid. Other shapes of reinforcement element are also useful.

The use of reinforcement elements in a casting can enable a reduction in weight of a casting for a given size of casting.

The carrier 110 is in the form of a sheet of aluminium metal cut to form a net 110N illustrated schematically in FIG. 1(*b*). Shaded portion 113C represents a cut-out portion.

Once the net 110N has been cut (for example in a stamping operation or any other suitable operation) the net 110N is folded along lines 114F, 118F, 119F into the shape shown in FIG. 1(*a*).

The carrier 110 has a substantially annular disc portion 113 having four arms 115, 116 projecting therefrom at spaced apart intervals around a circumference thereof. In the arrangement shown the arms 115, 116 are angularly spaced at 90° intervals about the disc portion 113. Other angles are also useful. In the embodiment shown one of the arms 116 is longer than the other three 115.

It is to be understood that other shapes of carrier 110 are also useful.

Each of the arms 115, 116 has a tab 114 at a free end thereof being a portion of the arm 115, 116 that has been bent through an angle of substantially 90°. The tabs 114 depending from shorter arms 115 are arranged to be inserted into corresponding recesses 192 formed in a sidewall 190 of a mould 190M. The recesses are illustrated schematically in FIG. 2(*a*). The carrier 110 is shown coupled to the mould 190M in FIG. 2(*b*).

Tab 114 depending from the longer arm 116 is arranged to be hooked or otherwise coupled to a rim 119R of the mould 119M whereby the carrier 110 may be 'suspended' from the rim 119R.

The carrier 110 has a coupling tab 118 projecting from a radially inner edge of the disc portion 113 for coupling the carrier 110 to a reinforcement element 170 by welding such as resistance welding or like coupling method. A pair of coupling tabs 119 project from the longer arm 116 and are of a sufficient length to wrap around a reinforcement element 171 to mechanically clinch the element 171 to the carrier 110. In some alternative arrangements the tabs 119 are of a similar size to tab 118 depending from the disc portion 113. Other arrangements are also useful.

It is to be understood that in some embodiments one or both of tabs 119 depending from the longer arm 116 or tab 118 depending from the disc portion 113 may be absent. Tabs 118, 119 may be provided at additional or alternative locations depending on the required positions of reinforcement elements 170, 171.

Figure 2A:
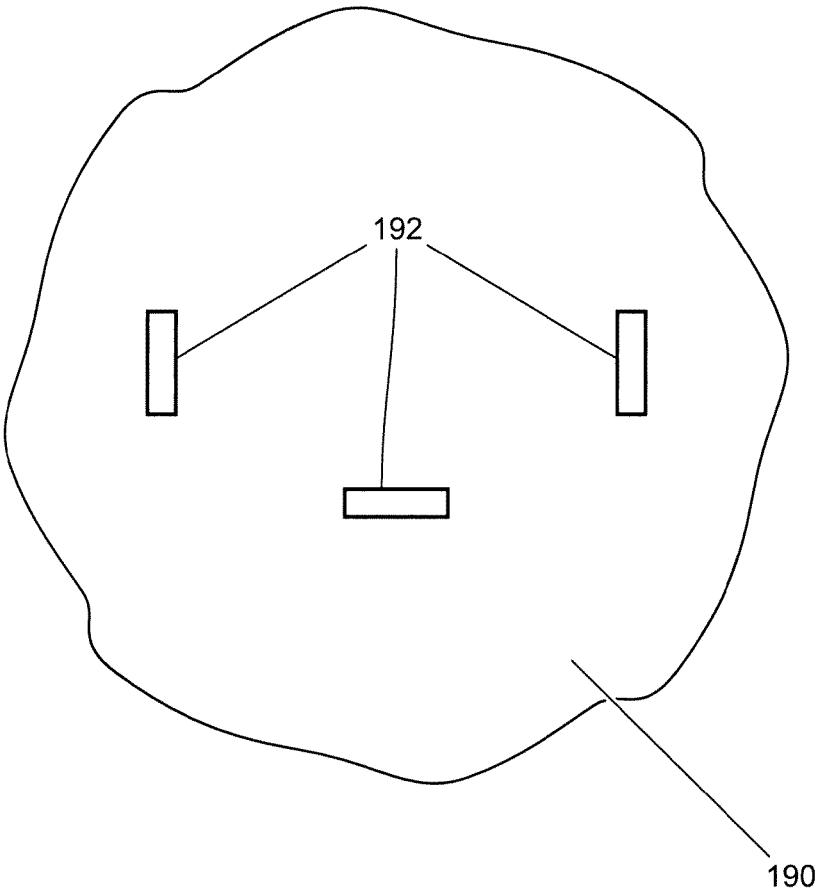
FIG. 2 shows (a) a portion of a sidewall of a mould and (b) a carrier according to an embodiment of the invention mounted to the sidewall of the mould.
Figure 2B:
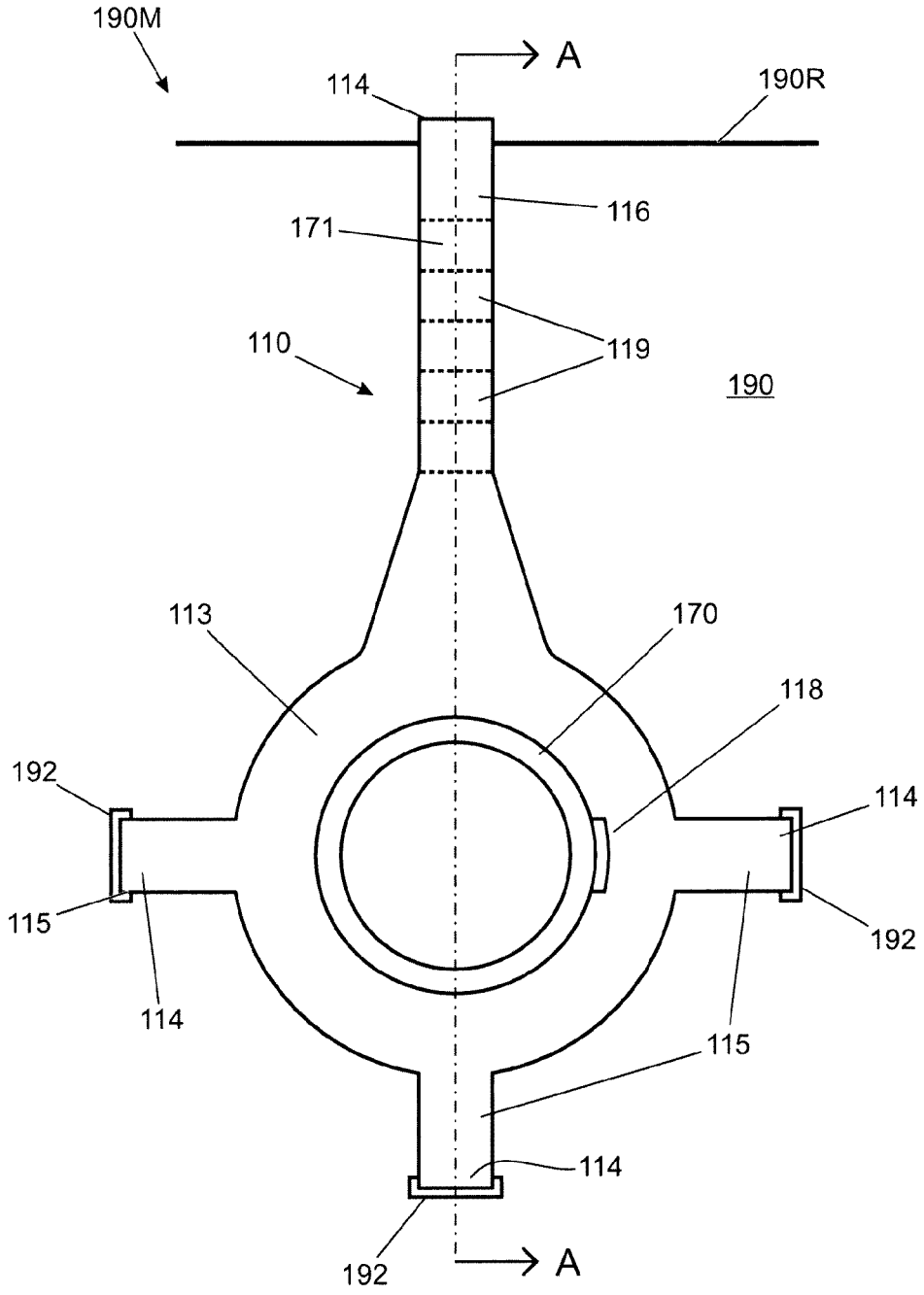
Figure 3:
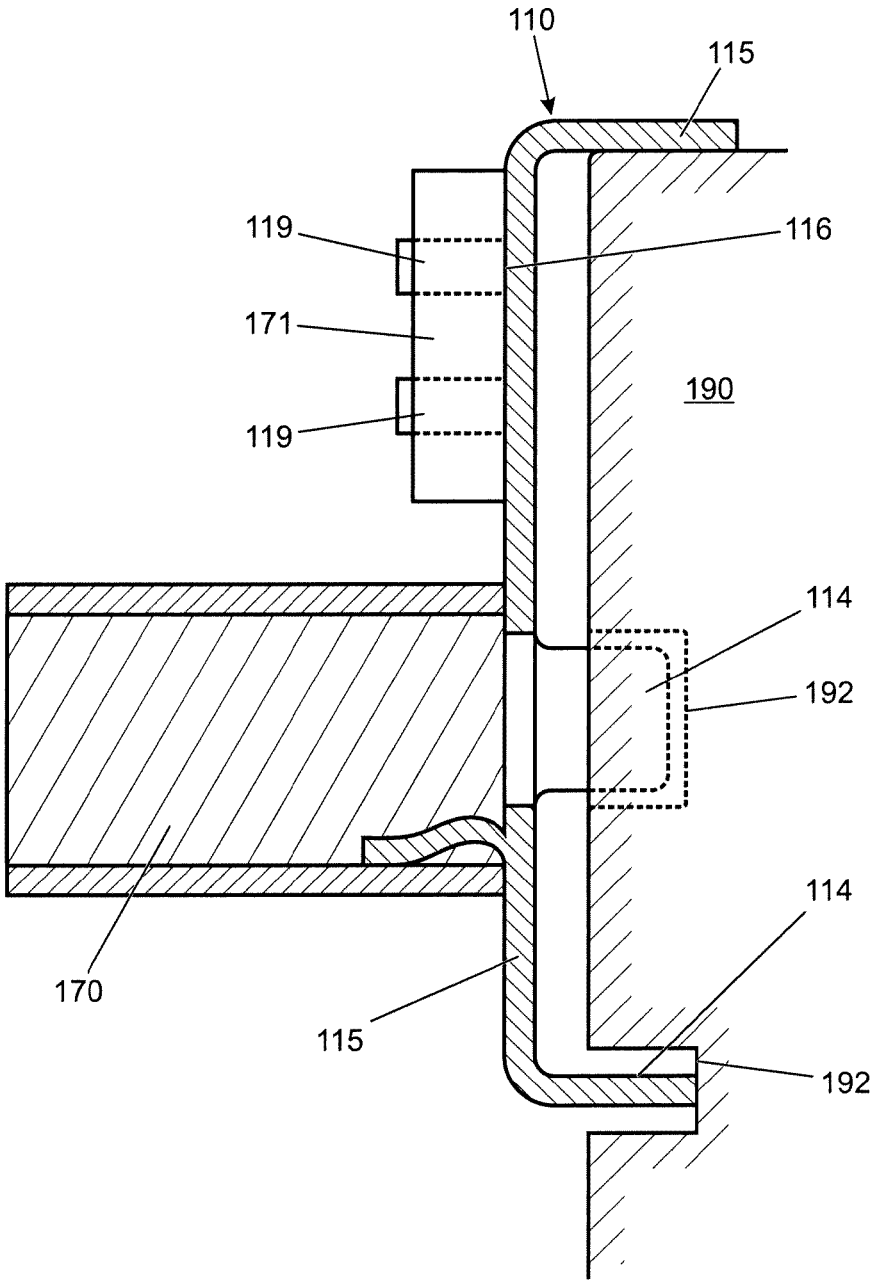
FIG. 3 is a cross-sectional view along line A-A of FIG. 2(*b*).

FIG. 3 is a cross-sectional view of the carrier 110 along line A-A of FIG. 2(*b*).

As noted above it is to be understood that in some embodiments of the present invention reinforcement elements 170, 171 may be attached to a carrier by wrapping tabs or other suitable portion or portions of the carrier around one or both elements, by welding such as spot welding, and/or by any other suitable means such as by means of an adhesive, by mechanical fixing means such as screws, bolts, rivets and the like, or by a molten metal process such as brazing or soldering.

It is to be understood that, whatever means are employed for coupling reinforcement elements to the carrier, the elements should be coupled sufficiently well that the elements do not become displaced, dislodged or otherwise moved from their desired positions within the mould 190M upon pouring molten metal into the mould 190M.

In some embodiments the carrier may be arranged to couple to a mould by clamping one or more portions of the carrier to the mould. In some embodiments a carrier may be arranged to be coupled to a mould by clamping or otherwise gripping one or more features or tabs of the carrier by a parting line of the mould. In other words, in the case of a mould that is provided in a plurality of sections that are held together, the carrier may be gripped between a respective two or more sections of the mould. In some arrangements an aperture may be provided in the mould at the parting line such that a portion of the carrier may be placed in the aperture in order to support the carrier.

It is to be understood that in some embodiments the carrier 110 may be formed from a wire material instead of a sheet material, or any other suitable medium for supporting one or more elements 170, 171. In some embodiments the carrier 110 is formed from a perforated sheet such as a mesh. In some arrangements this has the advantage that a more intimate bond between molten material poured into the mould 190M and the carrier 110 may be obtained. In some arrangements the presence of a perforated sheet improves flow of molten material thereby reducing a disturbance of flow due to the presence of the carrier 110. For example in some arrangements the perforated material allows flow of molten material therethrough.

Other arrangements are also useful.

In some embodiments the carrier may be formed from a reinforcement material and provide a reinforcement element itself.

Embodiments of the invention are particularly suited to high strength, low weight applications, for example for structural components of vehicles, aircraft, buildings and the like. For example in one embodiment a knuckle suspension component of a vehicle is formed by casting of aluminium into a mould 190M. The mould 190M has a carrier 110 provided therein formed from aluminium sheet. Reinforcement elements 170, 171 coupled to the carrier 110 are formed from an aluminium matrix composite material having a strength to weight ratio higher than that of aluminium, allowing a reduction in weight of the suspension component.

In some arrangements the carrier 110 may be formed from a different material such as an alloy material, optionally an aluminium alloy material. In some arrangements the carrier may be formed from a material that it is desirable to alloy with the molten material poured into the mould 190M, the carrier 110 being arranged to form an alloy with the molten material when the molten material is introduced into the cavity.

The reinforcement elements 170, 171 may be arranged to be provided in their desired locations once the molten material has solidified.

In some embodiments the carrier 110 is pre-heated before molten material is introduced into the mould 190M. In some embodiments the carrier is pre-heated to remove moisture that may be present on a surface thereof.

Once the molten material has solidified, the component, in the form of a cast body, is then removed from the mould 190M.

In some embodiments the step of casting molten metal in a mould 190M is followed by a pressing or forging operation of the cast body.

In some embodiments the casting operation is arranged such that the carrier 110 is substantially entirely contained within the cast body. Thus in some embodiments the carrier 110 may be mounted to a sidewall 190 of the mould 190M within the mould 190M.

In some alternative embodiments at least a portion of the carrier 110 protrudes out from the cast body. For example it can be seen in FIG. 3 that a portion of arm 116 and upper tab 114 may protrude from the cast body when the mould 190M is substantially filled with molten material.

The cast body may be formed by introducing molten material into a mould, die or the like. The mould or die may be formed from a metal, ceramic, sand or any other suitable material. One or more carriers may be coupled to an internal surface of the mould or die, or suspended within the mould or die. Other arrangements are also useful.

Embodiments of the invention have the advantage that cast or injection-moulded bodies such as aluminium components, other metal components including metal alloy components, plastics components and components formed from other materials may be formed to have improved structural properties.

Embodiments of the invention overcome the problem of locating one or more reinforcement components within a mould, die or the like in an accurate, reproducible manner. Some embodiments of the invention allow location of the one or more components in a relative rapid manner. Some embodiments of the invention allow location of the one or more components in a relative rapid, low cost manner.

It is to be understood that embodiments of the present invention may be employed to support elements other than reinforcement elements. Furthermore, embodiments of the invention may be employed in manufacturing processes other than casting processes such as injection moulding processes and the like.

Some embodiments of the invention eliminate a requirement to provide reinforcement elements or other elements to be included within a component that are sized and shaped to couple to or otherwise be supported by features of a mould (which may also be referred to as a mould tool). In some embodiments a requirement to provide a mould or the like having features that penetrate a surface of the cast body in order to support a reinforcement element is substantially eliminated.

Some embodiments of the present invention allow a reduction in an amount of time required to install reinforcement elements to a mould or die since the elements do not have to be installed individually. Rather, a plurality of elements may be installed by inserting a single carrier into the mould. It is to be understood that in some manufacturing processes a plurality of carriers bearing plural reinforcement elements may be placed in a mould or die.

Some embodiments of the invention provide an enhancement in quality control of component manufacture since a risk that a reinforcement element is incorrectly fitted inside a mould or is inadvertently omitted from a mould prior to introduction of molten metal is reduced.

Some embodiments of the invention allow more rapid inspection of a mould prior to introduction of molten metal. This is because an operator need only verify that a carrier has been inserted into the mould rather than that each reinforcement element has been correctly placed within the mould.

Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. An apparatus for forming a component from a solidified fluid medium, the apparatus comprising:

a body defining a cavity into which the fluid medium may be introduced, wherein the cavity is shaped to define a shape of the component; and a carrier comprising a sheet of material that defines a carrier body, wherein the carrier body comprises:

at least one folded portion coupling the carrier body to the body such that at least a part of the carrier body becomes part of the component when the fluid medium is introduced into the cavity, wherein the at least one folded portion is suspended from or inserted into a portion of the body to couple the carrier body to the body; and at least one folded coupling tab; and at least one metal matrix composite reinforcement element, wherein the at least one metal matrix composite reinforcement element is mechanically secured to the carrier body via the at least one folded coupling tab which wraps around the at least one metal matrix composite reinforcement element, and wherein the at least one metal matrix composite reinforcement element becomes part of the component.

2. An apparatus as claimed in claim 1 wherein the at least one folded portion couples to the body through abutting at least one corresponding portion of the body thereby to allow the carrier to be supported in a prescribed position and orientation within the cavity.

3. An apparatus as claimed in claim 2 wherein the body is provided with at least one recess within the cavity into which a corresponding at least one folded portion may be introduced.

4. An apparatus as claimed in claim 2 wherein the body is provided with one or more protrusions within the cavity, the carrier having a corresponding one or more portions into which the one or more protrusions of the body may be introduced.

5. An apparatus as claimed in claim 1 wherein the carrier comprises a carrier body having at least one arm portion protruding therefrom, the arm portion being arranged to be coupled to a portion of the body thereby to support the carrier body in the cavity.

6. An apparatus as claimed in claim 1 wherein the carrier comprises a material that is the same as the fluid medium to be introduced.

7. An apparatus as claimed in claim 1 wherein the carrier comprises aluminium.

8. An apparatus as claimed in claim 1 wherein the at least one metal matrix composite reinforcement element comprises an aluminium matrix composite (AMC) material.

9. An apparatus as claimed in claim 1 wherein the at least one metal matrix composite reinforcement element comprises a porous alumina structure within which an aluminium matrix is provided.

10. A method of fabricating a component comprising:

providing a body defining a cavity into which a fluid medium may be introduced, wherein the cavity is shaped to define a shape of the component;

providing a carrier comprising a sheet of material having foldable portions and foldable coupling tabs;

mechanically securing at least one metal matrix composite reinforcement element to the carrier by wrapping the foldable coupling tabs around the at least one metal matrix composite reinforcement element;

folding the foldable portions and coupling the carrier to the body within the cavity via the foldable portions by suspending the foldable portions from or inserting the foldable portions into a portion of the body; and introducing the fluid medium into the cavity whereby the at least one metal matrix composite reinforcement element is at least partially embedded in the fluid medium and whereby at least part of the carrier is embedded in the fluid medium.

11. A method as claimed in claim 10 wherein the step of introducing a fluid medium comprises the step of introducing a molten material.

12. A method as claimed in claim 11 whereby the molten material comprises a molten metal.

* * * * *